United States Patent [19]

Folb et al.

[11] Patent Number: 4,655,155

[45] Date of Patent: Apr. 7, 1987

[54] HIGH-SPEED FAIRED TOWLINE

[75] Inventors: Reece Folb, Laytonsville, Md.; Shelton M. Gay, Jr., Vienna, Va.

[73] Assignee: The United States of America as represented by the Secretary of the Navy, Bethesda, Md.

[21] Appl. No.: 695,510

[22] Filed: Jan. 28, 1985

[51] Int. Cl.[4] ..... B63B 21/00

[52] U.S. Cl. ..... 114/243

[58] Field of Search ..... 114/243, 244, 253, 254; 174/101.5; 244/35 R, 37, 130

[56] References Cited

U.S. PATENT DOCUMENTS

| | | | |
|---|---|---|---|
| 3,304,364 | 2/1967 | Hetherington | 114/243 |
| 3,352,274 | 11/1967 | Calkins | 114/243 |
| 3,443,020 | 5/1969 | Loshigian | 114/243 |
| 3,611,976 | 10/1971 | Hale | 114/243 |
| 3,613,627 | 10/1971 | Kennedy | 114/243 |
| 3,795,759 | 3/1974 | Rhyne | 114/254 |

FOREIGN PATENT DOCUMENTS

| | | | |
|---|---|---|---|
| 92571 | 11/1968 | France | 114/243 |

*Primary Examiner*—Galen Barefoot
*Assistant Examiner*—Jesûs D. Sotelo
*Attorney, Agent, or Firm*—Luther A. Marsh

[57] ABSTRACT

A faired towline comprises a load-bearing member, as the leading edge member, that has a cross-sectional configuration of a rectangle with rounded corners and the longer dimension being the vertical one, an elastomeric fairing that is in continuous contact with the load-bearing member, and a smooth, tough covering for both members.

15 Claims, 5 Drawing Figures

HIGH-SPEED FAIRED TOWLINE

BACKGROUND OF THE INVENTION

1. Field of the Invention

This invention relates to an underwater towline and more particularly to a low-drag and high-strength towline for towing an object under water at high speeds.

2. Brief Description of the Prior Art

High drag forces on towed devices tend to cause the device to stream out near the water surface behind the towing vessel unless depressing forces are applied to submerge the device. These depressing forces are usually applied by means of flaps and control surfaces on the towed devices, wherein the resultant depressing forces and drag forces on the towed devices are carried as tension forces in the towing cables or faired towlines that extend between the ship and the towed devices.

Drag forces, which are also produced on the towlines, are generally a function of the towing speed, the size of the towline, and the shape of the towline. Attempts to reduce the resultant drag forces on the towlines include the fabrication of streamlined integrated towlines having rounded leading edge portions and tapered trailing edge portions, as exemplified, for example, by U.S. Pat. Nos. 3,304,364; 3,352,274; 3,443,020; 3,611,976; and 3,613,627. In the type of towlines disclosed by these natents, the load bearing member typically consists of parallel glass fibers embedded in epoxy matrix for strength purposes, and a fairing is constructed of material having a low modulus of elasticity. The load bearing and fairing members of the towlines are provided with a rubber impregnated cloth covering which serves to maintain the structural integrity and shape stability of the towline.

However, attempts to tow submerged devices at preselected depths and at predetermined orientation beneath the towing vessel have often been unsuccessful due to "kiting" instabilities and erratic deflections of the towline. For example, towing tests with towlines of the type shown in U.S. Pat. No. 3,613,627 have shown the towline to be susceptible to hydrodynamic and mechanical instabilities as well as shape asymmetries that produce excessive towline kiting. Further the highly streamlined glass fiber-epoxy tensile members which form the load-bearing member of the towline are structurally unstable when curved in the plane of the chordline, (i.e., the towline is bent in the direction of relative flow as must occur for equilibrium). This structural instability, which is compounded by the structural instability of the trailing rubber fairing portion, must be compensated for by the natural hydrodynamic stability forces produced on the towline surfaces by the water.

In prior towline analysis, the stabilizing forces have been treated as if the faired section were longitudinally rigid in the chordwise direction. However, in actuality, the elasticity of the fairing of the towline, which must be of a soft material to minimize the buckling instability occasioned by the forward curvature of the towline, leads to a substantial reduction in the hydrodynamic stabilizing moments and forces on the towlines. Prior analysis considered the shift of the center of tension in the fairing as the controlling factor. Also, small separations of the interface bond between the load bearing and fairing members of the towline have been known to produce irregular lateral displacements of the tapered trailing portion relative to the load-bearing member to produce a longitudinal shape asymmetry in the towline.

This factor was also ignored in prior art analyses. However, shape asymmetry occurring in a portion of the fairing causes unbalanced hydrodynamic forces thereabout which cause the length of towline to deviate severely from the intended planar configuration and thus results in substantial loss of depth and control capability. Prior analyses also disregard the effect of the torques induced in the load-bearing member when displaced out of plane.

SUMMARY OF THE INVENTION

It is, therefore, an object of the present invention to increase the hydromechanical stability of underwater towlines.

A further object of this invention is to diminish the effect of construction asymmetrics on the hydromechanical stability of an underwater towline.

Another object of this invention is to increase towing speeds and improve control of the depth of a towed object.

Another object of this invention is to decrease the bending radius of a towing line so that it can be wound on a smaller drum.

And another object of this invention is to increase the durability of underwater towlines.

These and other objects are achieved by a composite towline having a load-bearing member that forms the leading edge of the towline and has a cross-sectional shape of a rectangle wherein the shorter dimension of the rectangle is the front-to-back dimension of the member and the front corners of the rectangle are rounded so that the towing line has a blunt-nose shape and the second-moment-of-area about the cross-sectional vertical axis intersecting the centroid of the load-bearing member is less than the second-moment-of-area about the horizontal axis passing through the centroid. An elastomeric fairing is attached continuously along the back edge of the load-bearing member, and a smooth material covers both members. The blunt-nose shape of the towing line has reduced bending stresses which increases hydromechanic stability and a shorter bending radius which permits the towing line to wind around a smaller drum.

BRIEF DESCRIPTION OF THE DRAWINGS

A more complete appreciation of the invention will become apparent from the following detailed description when considered in connection with the accompanying drawings wherein.

DETAILED DESCRIPTION OF THE INVENTION

Figure 1:
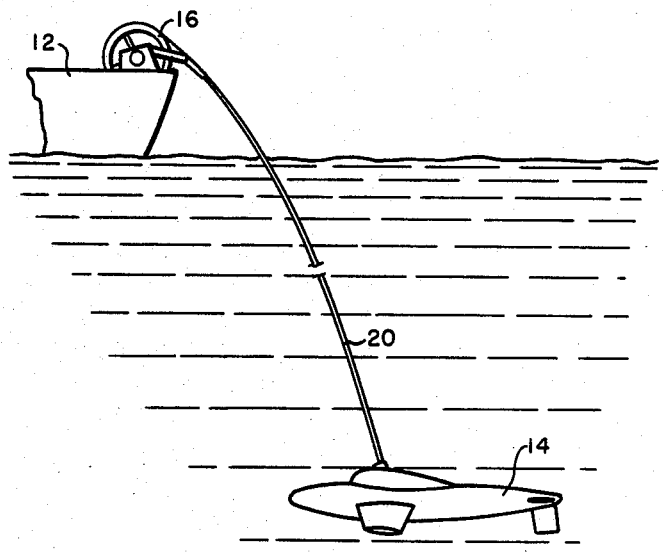
FIG. 1 is a pictorial diagram of the typical environment for the towline of the present invention.

Referring now to the drawings and, in particular to FIG. 1, there is generally shown a composite towline 20 deployed behind the stern 12 of a vessel wherein the towline 20 is conventionally connected to the vessel by means of a "take-up" winding drum 16 rotatably secured to the stern 12 of the vessel. The remote end portion of the towline 20 is connected to a submersible towed device 14 such as a depressor, a paravane, or a sonar module. Operating depths for many types of towed devices are on the order of hundreds of feet and, consequently, considerable fairing lengths are often required for the devices. Thus, the towline 20 must be strong enough to support large towing loads at great depths and have sufficient flexibility to permit easy deployment (and retrieval) of towline 20 from the storage drum 16. The towline 20 should also have a high degree of symmetry and lateral stability to preclude twisting and "kiting" of the towline from the desired tow orientation.

It is known that the tow stability of a hydrodynamically efficient towline is assured by maintaining the center of tension (CT), which is the point through which the resultant tensile force acts on the towline, forward of the hydrodynamic center (HC), which is defined as the point through which the resultant lift and drag forces act on the towline 20. The hydrodynamics center (HC) is generally located about one-fourth of the chord distance from the leading edge of the towline for NACA-shaped towlines. In practice, the center of tension (CT) usually coincides with the center of rotation (CR), which is defined as the longitudinal axis about which the towline 20 rotates when unbalanced lift and drag forces act on the towline 20. Accordingly, the towline 20 will generally exhibit overall tow stability if the centers of rotation (CR) and tension (CT) are maintained forward of the hydrodynamic center (HC) during towing.

Figure 2:
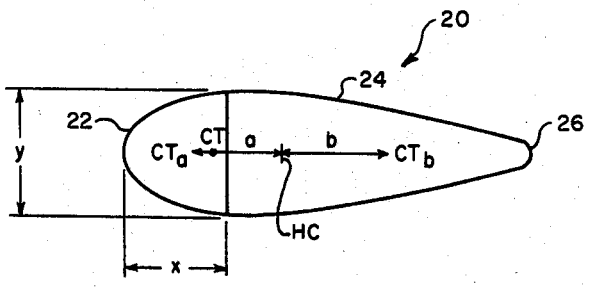
FIG. 2 shows a diagrammatic view of a prior art cable with the associated hydrodynamic vectors.

The location of the center of tension (CT) and the center of rotation (CR) primarily depends upon the product of the modulus of elasticity (E) of the different members of the towline and the cross-sectional area occupied by each member. For example, FIG. 2 illustrates a cross-section of a composite, integrated prior art towline in which the load-bearing member and fairing 22 and 24 have resultant centers of tension ($CT_a$; $CT_b$) which are spaced distances (a, b) from the hydrodynamic center (HC) of the towline. As the towline moves through the water and assumes a catenary shape, as shown in FIG. 1, the trailing portion deforms more than the load-bearing member 22 so that the center of tension ($CT_b$) of fairing 26 moves aft toward the trailing edge 26 of towline 20. As a result, the resultant center of tension (CT) of the towline 20 shifts toward the trailing edge of the towline. If the resultant center of tension (CT) substantially coincides with the hydrodynamic center (HC), the towline becomes inherently unstable and tends to flip or oscillate from side to side about the center of rotation (CR). This results in substantial loss of depth and control capability.

The above analysis is based on the premise that since the load-bearing member bends much less than the fairing during use, the load-bearing member contributes little to the shift of the center of tension, TC, of the towline. This analysis also disregards the torques induced in the load-bearing member. Previous design efforts were accordingly directed to minimizing the shift of the center of tension $CT_b$, in the fairing and moving initial center of tension, $CT_a$, in the load-bearing member as far forward as possible. This design approach emphasized streamlining the cross-sectional shape of the towline, thereby requiring the load-bearing member to have a minimum frontal area and a cross-sectional front-to-back dimension, x, longer and usually much longer than the cross-sectional top-to-bottom dimension. This design approach is shown and discussed in U.S. Pat. No. 3,613,627.

It has been determined through extensive experimentation and analysis that the load-bearing member makes a substantial contribution to the shift of the center of tension, CT, of a towline in a catenary shape, such as that shown in FIG. 1. Further, the shift is a function of the relative lengths of the two cross-sectional dimensions. If the x dimension is greater than the y dimension, the load bearing member is bent parallel to its major axis rather than parallel to its minor axis. Thus, the bending axis and major axis are not located together but are perpendicular to each other which greatly increases the bending stresses in the load bearing member and significantly moves the center of tension, $CT_a$, towards the back. Hence, the center of the tension, TC, of the towline is moved back to or beyond the hydrodynamic center, HC, and the towline becomes unstable.

Analysis and experimentation have also shown that in an out of the plane of the primary curvature of the towline, the torques induced in the load-bearing member cause the towline to twist unstably away from the plane of the primary curvature if the cross-sectional front-to-back dimension exceeds the cross-sectional top-to-bottom dimension. These torques exacerbate the kiting effects of the inherent asymmetries and towline damage. If the ratio of the two dimensions is reversed, the stresses or torques induced in the load-bearing member cause it to twist stably back toward the plane of primary curvature, thereby limiting the out-of-primary-plane (kiting) position that results from inherent asymmetry or towline damage. The induced torques act as a correcting mechanism.

The above explanation is given as a possible explanation of the greatly improved stability of the towlines of this invention, even though the shape of the towline is not streamlined. It is not meant to limit the disclosure or the claims to follow to any specific explanation.

Figure 3:
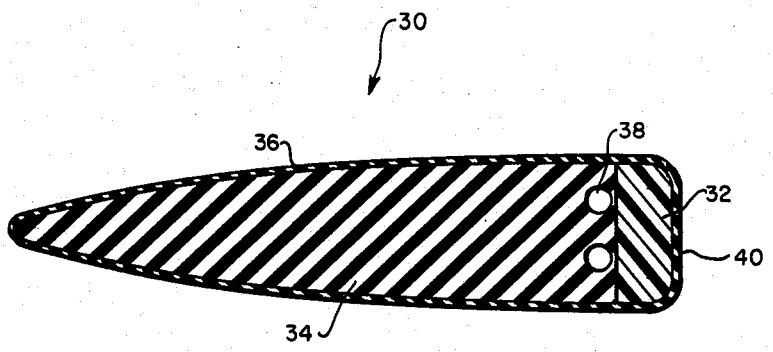
FIG. 3 shows a cross-sectional view of a towline of the present invention.
Figure 4:
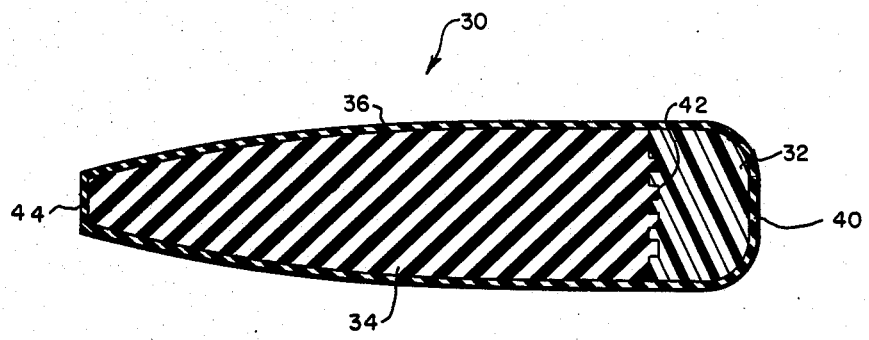
FIG. 4 shows a cross-sectional view of a towline of this invention having a notched interface between the load-bearing member and the fairing and a reduced curvature in the load-bearing member.
Figure 5:
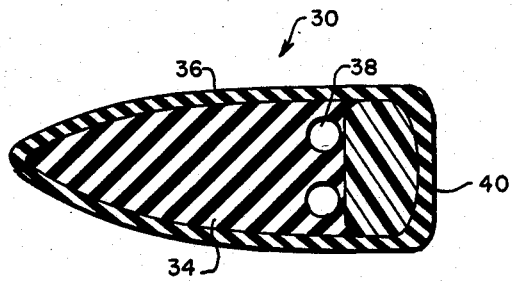
FIG. 5 shows a cross-sectional view of a towline of this invention having four rounded corners in the load-bearing member.

Towlines of this invention that are shown in FIGS. 3 to 5, have a cross-sectional front-to-back dimension that is smaller than the cross-sectional top-to-bottom dimension for the load-bearing member. These towlines are further characterized by a cross-sectional shape of a rectangle with rounded front corners for the load-bearing member. This cross-section is used because of the added strength of the increased mass. The corners at the leading edge of the towline are circular to minimize stress concentrations and flow separation at the leading edge. The back corners can be rounded also. Another characteristic of these towlines is that the second-moment-of-area about the cross-sectional vertical axis intersecting the centroid of the load-bearing member is less than the second-moment-of-area about the horizontal axis intersecting the centroid.

As shown in FIG. 3 the load-bearing member 32 of the towline 30 has a rectangular shape giving the towline 30 a blunt nose. Fairing 34 assumes a traditional faired shape. Covering member 36 helps to reduce drag forces, bind the load-bearing and fairing members together and provides protection for the cable. Load-bearing member 32 is typically of a high elastic modulus material, such as parallel strands or E or S glass in an epoxy matrix, and fairing 34 is typically a low-modulus elastomer to minimize its contribution to buckling instability. Cover 36 is typically an elastomer impregnated tape or fabric. The purpose of the covering is to provide a smooth surface for the towline. It can also be used to help hold the two members in continuous contact and to prevent lateral displacement between the two. Longitudinal openings 38 are placed in fairing 34 to carry electrical conductors from a ship to a towed body.

The corners of the cross-sectional rectangle at the leading edge are rounded to avoid stress concentrations and to prevent flow separation at the leading edge. The percent of the rectangular side 40 at the leading edge that is not rounded is from about 20 to 90 percent, preferably from 40 to 80 percent, and most preferably from 60 to 80 percent. The circular corners do not necessarily have a single radius of curvature. The cross-sectional top-to-bottom dimension is at least greater than the length of the cross-sectional front-to-back dimension and preferably is 2 to 5 times greater, and most preferably 3½ to 4 times greater. In designing a load-bearing member, it is necessary to have the second moment of area about the cross-sectional vertical axis through the centroid being less than the second moment of area about the corresponding horizontal axis.

By designing the cross-sectional top-to-bottom dimension of the load-bearing member to be greater than the front-to-back dimension, the load-bearing member is positively stable when bent in the towing curve. Indeed, if the difference in the dimensions is large enough, the instability caused by fairing 34 can be overcome, so that, the entire towline has a positive stability or at worst be neutrally stable. This arrangement is in contradistinction to the more highly streamlined arrangement of the prior art where destabilizing moments necessarily accompany the bending caused by towing.

Moreover, the blunt nose of the subject towline makes it less sensitive in terms of the side forces or lift (as with an airfoil) due to circulations arising from slight asymmetries. In addition, due to stability limitations of the more highly streamlined towlines, the load efficiency of the new section is increased compared to the typical airfoil design approach so that the towline using the present invention can be thinner for the same strength than the towline developed using a conventional airfoil shape.

The design of the present invention also produces improved handling characteristics. Since the front to back dimension is smaller than prior art devices, the stress involved in winding the cable around a small drum is considerably less. Thus, smaller drums may be used which saves space on the boat towing the cable. Also, the new cable is less prone to damage when passing over rollers due to the larger surface area of the nose.

FIG. 4 shows a towline 30 with a less blunt load-bearing member 32 and the interface 42 between the load-bearing member 32 and the fairing is notched to reduce lateral displacement between the two members. Lateral displacement causes asymmetries which can produce added torque on the cable. Other restraining techniques can be used, such as tongue and groove or a large project of one member into the other. Strong adhesive can be used as well as strongly binding coverings. The trailing edge 44 of the fairing can be truncated. Truncation can improve the bending radius and the storage capability of the towline.

FIG. 5 shows a towline 30 with all cross-sectional corners of the load-bearing member being rounded. The amount that the cross-sectional corners is rounded is slight. Generally the rounding causes no more than about 10 to 15 percent of the back cross-sectional side to be curved. This contrasts with the amount of curvature of the front side which can have as much as 90 percent curved, although typically the amount is from 20 to 40 percent of the side.

Numerous modifications and variations of the present invention are possible in light of the above teachings. It is therefore to be understood that within the scope of the appended claims, the invention may be practiced otherwise than as specifically described herein.

What is claimed is:

1. A faired twoline for towing submerged objects which comrpises:

a leading-edge elongated load-bearing member, said load-bearing member having a cross-sectional shape of a rectangle wherein the top-to-bottom dimension is the longer one, the rectangular corners at the leading edge of said towline are rounded so that 20 to 90 percent of the rectangular side in the leading edge of said towline is linear, and the second-movemnt-of-area about the vertical axis at the centroid of the member is less than the second-moment-of-area about the horizontal axis at the centroid;

a flexible fairing, in continuous contact with said load-bearing member; and a smooth material which encloses said load-bearing member and said fairing so that a smooth surface is provided for said towline.

2. The towline of claim 1 wherein the top-to-bottom dimension is from 2 to 5 times greater than the front-to-back dimension.

3. The towline of claim 2 wherein the top-to-bottom dimension is from 3½ to 4 times greater than the front-to-back dimension.

4. The towline of claim 1 wherein the rectangular corners are rounded so that 40 to 80 percent of the rectangular side in the leading edge of said towline is linear.

5. The towline of claim 4 wherein the rectangular corners are rounded so that 60 to 80 percent of the rectangular side in the leading edge of said towline is linear.

6. The towline of claim 5 wherein the top-to-bottom dimension is from 2 to 5 times greater than the front-to-back dimension.

7. The towline of claim 5 wherein the top-to-bottom dimension is from 3.5 to 4 times greater than the front-to-back dimension.

8. The towline of claim 4 wherein the top-to-bottom dimension is from 2 to 5 times greater than the front-to-back dimension.

9. The towline of claim 4 wherein the top-to bottom dimension is from 3.5 to 4 times greater than the front-to-back dimension.

10. The towline of claim 1 wherein the top-to-bottom dimension is from 3.5 to 4 times greater than the front-to-back dimension.

11. A faired towline for towing submerged objects which comprises:

a leading-edge elongated load-bearing member, said load-bearing member having a cross-sectional shape of a rectangle wherein the top-to-bottom dimension is from 2 to 5 times greater than the front-to-back dimension, the rectangular corners are rounded at the leading edge so that 40 to 80 percent of the rectangular side in the leading edge of said towline is linear, and the second-moment-of-area about the vertical axis at the centroid of the member is less than the second-moment-of-area about the horizontal axis at the centroid;

a flexible fairing in continuous contact with said load-bearing member; and a smooth material which encloses said load-bearing member and said fairing so that a smooth surface is provided for said towline.

12. The towline of claim 11 wherein the top-to-bottom dimension is from 3½ to 4 times greater than than the front-to-back dimension.

13. The towline of claim 12 wherein the rectangular corners at the leading edge are rounded so that 60 to 80 percent of the rectangular side in the leading edge of said towline is linear.

14. The towline of claim 13 wherein the other rectangular corners are rounded so that 10 to 15 percent of the rectangular side at the interface between said load-bearing member and said fairing is curved.

15. The towline of claim 11 wherein the rectangular corners at the leading edge are rounded so that 60 to 80 percent of the rectangular side in the leading edge of said towline is linear.

* * * * *